US007159861B2

(12) United States Patent
Duesterhus

(10) Patent No.: US 7,159,861 B2
(45) Date of Patent: Jan. 9, 2007

(54) DEVICE FOR THE DELIVERY OR RECEIPT OF INDIVIDUAL SHEETS

(75) Inventor: Richard Duesterhus, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 120 days.

(21) Appl. No.: 10/466,274

(22) PCT Filed: Jan. 15, 2002

(86) PCT No.: PCT/EP02/00348

§ 371 (c)(1),
(2), (4) Date: Oct. 27, 2003

(87) PCT Pub. No.: WO02/062688

PCT Pub. Date: Aug. 15, 2002

(65) Prior Publication Data

US 2004/0056414 A1 Mar. 25, 2004

(30) Foreign Application Priority Data

Jan. 15, 2001 (DE) ..... 101 01 563

(51) Int. Cl.
*B65H 83/00* (2006.01)
*B65H 3/06* (2006.01)

(52) U.S. Cl. ..... 271/3.01; 271/119; 271/3.12

(58) Field of Classification Search ..... 271/188, 271/19, 27, 22, 113, 119, 3.01, 3.12, 4.01, 271/10.11

See application file for complete search history.

(56) References Cited

U.S. PATENT DOCUMENTS 3,806,114 A * 4/1974 Carter ..... 271/20

(Continued)

FOREIGN PATENT DOCUMENTS

DE 16 11 419 A 2/1972

(Continued)

OTHER PUBLICATIONS

Communication from European Patent Office including International Search Report, dated Jun. 5, 2002, 5 pages.

*Primary Examiner*—Patrick Mackey
*Assistant Examiner*—Kaitlin Joerger
(74) *Attorney, Agent, or Firm*—Michaud-Duffy Group LLP

(57) ABSTRACT

A device for the delivery or receipt of individual sheets (16), comprises a parallelepiped container (12), in which the individual sheets (16) are stored in the form of a sheet stack (14) and are pressed against the container wall parallel to a stack end face (56), by means of a platen device (58), which comprises a rectangular through opening (50) with first edges with a mutual separation at least the same as a first edge length of the individual sheets (16) and with second edges (52, 54), the mutual separation of which is smaller than the other edge length of the individual sheets, a sheet transport (36), operating in the through opening (50) and contacting with the stack end face (56) for transport of an individual sheet (16), parallel to the stack end face (56) and perpendicular to the second edges (52, 54), two transport rollers (22, 24) arranged with axes (26) parallel to the stack end face (56) and to the second edges (52, 54), forming a roller gap for gripping an individual sheet (16). One of said transport rollers (22, 24) is arranged close to one of the second edges (52, 54), such as to—viewed perpendicular to the stack end face (56) lie at least partly within the through opening (50). The invention further comprises a drive means (42, 30) for driving the sheet transport (36) and the transport rollers (22, 24).

9 Claims, 3 Drawing Sheets

U.S. PATENT DOCUMENTS

| | | | | | |
|---|---|---|---|---|---|
| 4,372,549 | A | * | 2/1983 | Stiernspetz | 271/23 |
| 4,463,943 | A | * | 8/1984 | Deconinck | 271/21 |
| 4,682,768 | A | * | 7/1987 | Iida et al. | 271/3.01 |
| 4,981,235 | A | * | 1/1991 | Ferrini et al. | 221/23 |
| 5,451,038 | A | * | 9/1995 | Hosking et al. | 271/3.01 |
| 6,068,157 | A | * | 5/2000 | Kamiya | 221/36 |
| 6,715,750 | B1 | * | 4/2004 | Gerlier et al. | 271/21 |

FOREIGN PATENT DOCUMENTS

| | | | | |
|---|---|---|---|---|
| DE | 35 20 890 | A | | 12/1986 |
| DE | 44 08 981 | C | | 6/1995 |
| EP | 0 047 541 | A1 | | 3/1982 |
| EP | 0 364 790 | A | | 4/1990 |
| EP | 0 436 147 | A2 | | 7/1991 |
| EP | 1 053 962 | A | | 11/2000 |
| FR | 990 863 | A | | 9/1951 |
| JP | 56028137 | A | * | 3/1981 |
| JP | 63082239 | A | * | 4/1988 |
| JP | 05024676 | A | * | 2/1993 |

* cited by examiner

DEVICE FOR THE DELIVERY OR RECEIPT OF INDIVIDUAL SHEETS

CROSS-REFERENCE TO RELATED APPLICATIONS

This application is entitled to the benefit of and incorporates by reference essential subject matter disclosed in International Application No. PCT/EP02/00348 filed on Jan. 15, 2002 and German Patent Application No. 101 01 563.1 filed on Jan. 15, 2001.

FIELD OF THE INVENTION

The invention concerns a device for the delivery and/or receipt of individual sheets, especially bank notes.

BACKGROUND OF THE INVENTION

Money dispensing automats are known in the case of which the bank notes are contained in collecting containers in the form of a bank note stack and are withdrawn through the help of a withdrawing and individualizing mechanism. These withdrawing and individualizing mechanisms usually have a withdrawing roll which extends into an opening in a forward wall of the container parallel to the stack end face and drives the upper most sheet of the stack into a roll gap formed between a transport roll and a stripping roll. One such device, as for example described in DE 44 08 981, is suited however only for the removal of individual sheets from the container. An orderly transport and placement of sheets into the container is not possible with it.

On the other hand, for example from EP-A-333 102 a device is known for the receiving and orderly depositing of individual sheets into a container. In this case, the individual sheets coming from a transport path with the help of a stacking mechanism are arranged on edge into a stack on a stacking platform, which stack is then by means of a tamping device pushed through the input opening of an adjoining collecting container, so that the individual sheets are deposited into the container in the form of a sheet stack. For one thing the stacking and tamping device both in regard to the mechanical components as well as to the space requirement is relatively expensive, and on the other hand it is not suited to again remove individual sheets from the same container.

The invention has as its object the provision of a device with the help of which selectively individual sheets stored in a container in the form of a sheet stack can be individually delivered or sheets can be individually transported to the container to form a sheet stack in the container.

SUMMARY OF THE INVENTION

The present invention is directed to a device for the delivery and/or receipt of individual sheets, in particular individual bank notes. The device includes a parallelepiped container wherein the individual sheets are stored in the form of a sheet stack and by means of a pressing device are pressed against a container wall parallel to one end face of the stack. The container wall has a rectangular pass-through opening with first opposite edges whose spacing from one another is equal to a first edge length of the individual sheets. The opening is defined in-part by second opposite edges whose spacing from one another is smaller than the other edge length of the individual sheets. A sheet pusher is designed to extend into the pass-through opening and to lie onto the end surface of the stack for pushing an individual sheet parallel to the stack end surface and perpendicular to the second edges. Two transport rollers are included with axes arranged parallel to the stack end surface and to the second edges and which form a roll gap for gripping an individual sheet.

One of the transport rolls is arranged near one of the second edges so that it lies at least partially inside of the pass-through opening and drive means for driving the sheet pusher and the transport rolls.

If in the solution of the invention the sheet pusher is actuated, it attempts to push in the plane of the sheet the individual sheet which forms the stack end surface. Since the sheet however cannot move inside of the container, it is buckled and becomes curved with the formation of a sheet bulge extending outwardly through the pass-through opening. In this way the sheet bulge comes into engagement with the transport roll lying adjacent to the stack end surface which transport roll then grips the sheet by friction and pulls the end of the sheet lying toward the shifting direction of the sheet shifter oppositely to the sheet shifting direction and from behind and away from the associated second edge. The freed sheet edge therefore because of the sheet tension and the effect of the transport roll moves into the roll gap so that it can be moved in conventional way away from the container by the two transport rolls acting in common.

Surprisingly it has been shown that in this way not only a trouble-free individualizing of the sheets is possible, but also that by reversing the drive direction of the drive means which drives the transport rolls and the sheet shifter individual sheets can be driven through the transport rolls to the container and with the help of the sheet shifter can be inserted into the container with the sheet sliding along the momentary stack end surface of the sheet stack standing in the container. To simplify the secure and exact delivery of the individual sheets to the sheet shifter it is in this case practical if between the transport rolls and the sheet shifter is arranged a sheet guide plate which bridges the spacing between the roll gap and the contact surface of the sheet shifter at the stack end face.

Preferably the sheet shifter has at least one engagement element eccentrically supported on an axis parallel to the stack end face. This has the advantage that the drive of the sheet shifter can be a rotary drive which is more simple to realize than the drive for a back and forth moving element. One such eccentrically supported engagement element can for example be made in the form of a segment roller which during its rotation comes into contact with the outer surface of the sheet only with the arcuate segment protruding part of its periphery. The axial spacing of the engagement element from the stack end face can be so measured that by way of the engagement element a light pressure is exerted onto the stack end surface by way of which the individual sheet which forms the stack end surface is slightly lifted from the pass-through opening container walls so that it can be more easily be drawn from behind the second edges or can be more easily be inserted behind these edges.

Preferably the sheet shifter and the transport rolls together with the drive means are arranged on a frame into which the container is slidable. In this way the container construction is simplified. The container requires only a closure flap which closes the pass-through opening so long as the container is located outside of the frame, and which upon the insertion of the container is automatically opened as is already known in regard to cassettes for money dispensing automats.

To simplify a secure slip free transport of the withdrawn sheets, it is practical if the transport rolls each have a plurality of coaxial rollers axially spaced from one another with the rollers of one roll lying in the axial direction between the rollers of the other roll. Thereby there exists, taking into consideration the axial direction, a slightly meander-shaped roll gap which ensures a secure gripping of the rollers with the outer surface of the sheet.

Preferably the transport rolls are so arranged that the axes of the two transport rolls lie in a plane perpendicular to the stack end face and parallel to the second edges.

A modified exemplary embodiment of the solution of the invention is described in claim 9. The withdrawal of individual sheets takes place according to the same principle, with however, the movably supported transport roll in addition to its transport and withdrawal function also taking on the function of the sheet shifter. In this case the transport roll lies on the stack end face and is so driven that it buckles the sheet with the formation of a sheet bulge until the sheet lies on the circumference of the transport roll. Then the transport roll is moved in the direction toward the other transport roll to form the roll gap so that the sheet becomes gripped by the two transport rolls and can be transported away from the container. The receipt of sheets again takes place by the reversal of the rotational direction of the transport rolls, with here a corresponding guide plate being also advantageously provided with the help of which the sheet just delivered by the transport rolls is guided into the pass-through opening of the container.

To undertake the adjustment of the transport roll at the right time, the positioning mechanism is advantageously coupled with a sensor which detects the size of the sheet bulge formed by the shifting of the sheet perpendicularly to the second edges. One such sensor can for example be a light cell whose light path is broken by the formation of the sheet bulge or otherwise by the leading end of a delivered individual sheet, to in this way effect the adjustment of the transport roll.

In an especially easy to realize embodiment the adjustable transport roll is supported on an end of a pivotable lever which is pivotable by a positioning magnet.

BRIEF DESCRIPTION OF THE DRAWINGS

Further features and advantages of the invention will be apparent from the following description which in combination with the accompanying drawings explains the invention by way exemplary embodiments. The drawings are.

DETAILED DESCRIPTION OF THE PREFERRED EMBODIMENTS

Figure 1:
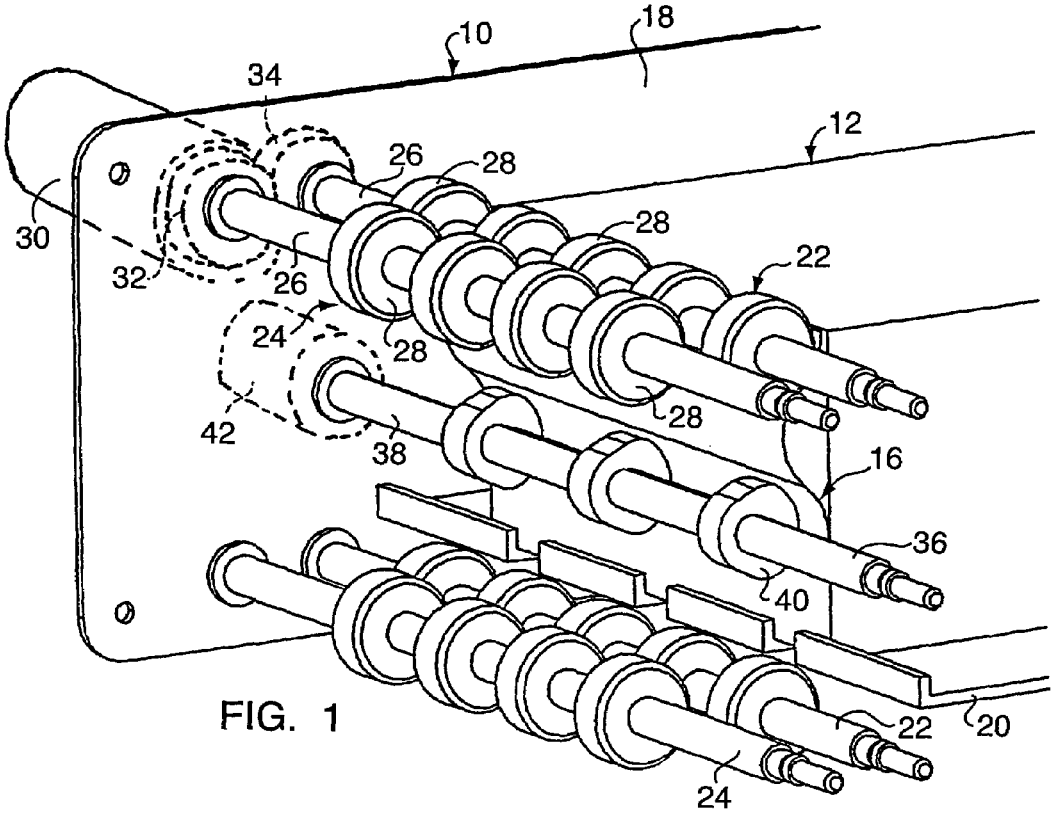
FIG. 1 is a schematic perspective partial view of the withdrawal and transport mechanism and of the end of the container facing

In FIG. 1 a slide-in frame is indicated at 10, which frame is for a parallelepiped container 12 serving to receive a stack 14 (FIG. 2) of individual sheets 16. The frame 10 is part of a device for the delivery or receipt of individual sheets, especially bank notes. Of the frame 10 only one side wall 18 is to be seen, which through a slide in bottom 20 is connected with a second non-illustrated side wall parallel to the side wall 18.

Between the two side walls 18 of the frame 10 extend two transport rolls 22, 24 each of which consists of a shaft 26 supported in the side walls 18 and rollers 28 arranged thereon. The rollers 28 on each shaft 26 have an axial spacing from one another, with the rollers 28 of the transport roll 22 with respect to the rollers 28 of the transport roll 24 being so axially displaced that the transport rollers 28 of one roll are received between the rollers 28 of the other transport roll.

The shaft 26 of the transport roll 24 is driven by a motor 30 and in turn drives the transport roll 22 by means of a gear 32 and a gear 34 non-rotably connected with the shaft 26 of the transport roll 22.

Below the transport rolls 22 and 24 is arranged a sheet pusher in the form of a segment roll 36, which has a shaft 38 parallel to the shafts 26 of the transport rolls 22 and 24 and has arranged on it a plurality of segment rollers 40. The shaft 38 of the segment roll 36 is coupled with a motor 42. It can however, also be coupled through a suitable drive with the drive motor 30 for the transport rolls 22, 24.

The transport rolls 22, 24 arranged below the slide in bottom 20 are identical to the upper transport rolls 22, 24 and belong to a further sheet storage unit.

The container 12 has a bottom 44, a cover 46 and side walls 48, and at its end facing the transport mechanism 22, 24 a pass-through opening 50. The measurement of the opening 50 parallel to the direction of the shafts 26 is equal to the spacing of the side walls 48. On the other hand, from the bottom 44 and the cover 46 there extends from each an edge flange 52 and 54, upwardly and downwardly respectively, so that the measurement of the opening 50 perpendicular to the bottom 44 is smaller than the distance between the bottom 44 and the cover 46 of the container. These edge flanges 52 and 54 therefore hold back the sheet stack 14 in the container 12, with the sheet stack 14 being pressed with its stack end surface 56 by a schematically illustrated pressing device 58 against the edge flanges 52 and 54. A flap for closing the pass-through opening is just as little illustrated as is the rearward end of the container 12 since these parts have no significance in regard to the present invention.

Figure 2:
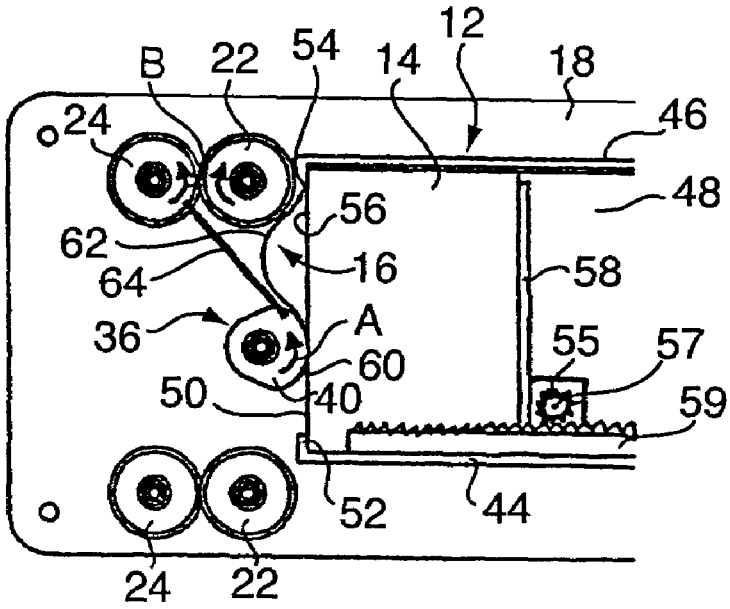
FIGS. 2 & 3 show schematic side views of the arrangement illustrated in FIG. 1 during the withdrawal of an individual sheet, and FIG. 4. is a schematic side view of the transport and withdrawal mechanism according to a second embodiment of the invention during the withdrawal of an individual sheet from a container.
Figure 3:
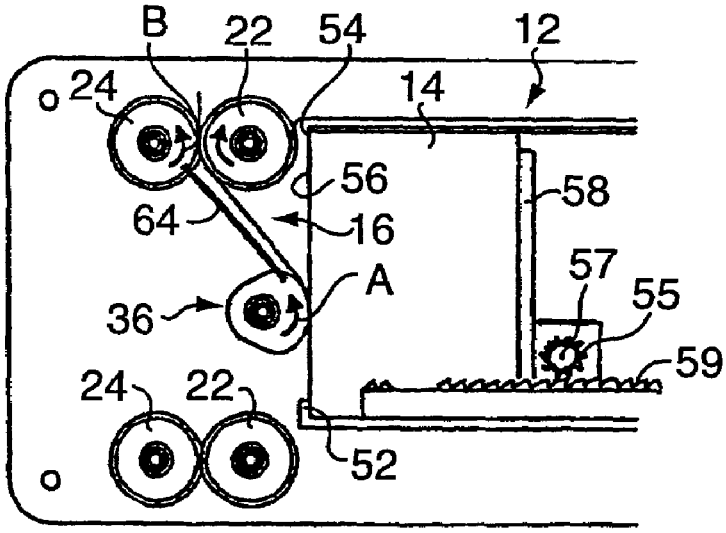

The way in which the withdrawing of individual sheets from the container 14 takes place is that the segment roll 36 in FIG. 2 is rotated in the counterclockwise direction, as indicated in FIG. 2 by the arrow A. The segment rollers 40 are so shaped and proportioned, that they with their arcuately shaped circumferential sections 60 extend into the opening 50 and exert a given pressure onto the stack 14 against the effect of the pressing device 58. With its rotational movement, the segment roll 36 shifts the individual sheet 16 forming the end surface 56 of the stack in the direction toward the cover 46. Since the sheet at this point cannot move to a new position, it is buckled and forms a sheet bulge 62 which approaches the transport roll 22. The transport rolls 22 and 24 are driven oppositely in the directions indicated by the arrows B. When the bulge 62 of the individual sheet 16 engages the transport roll 22 the individual sheet 16 is taken along by the transport roll 22 so that the end of the individual sheet 16 near the cover 46 is pulled away from its position behind the edge flange 44. Because of its sheet tension, the individual sheet remains lying on the outer surface of the roll 22. The now free end of the sheet is taken along by the transport roll 22 until the sheet turns and the free sheet end reaches the roll gap between the transport rolls 22 and 24. These transport rolls can now grip the sheet and transport it further, as is illustrated in FIG. 3. This process is further supported by a guide plate 64 which bridges the intervening space between the transport rolls 22, 24 and the segment roll 36, with the guide plate 64 however not being entirely necessary for the withdrawal process.

Figure 5:
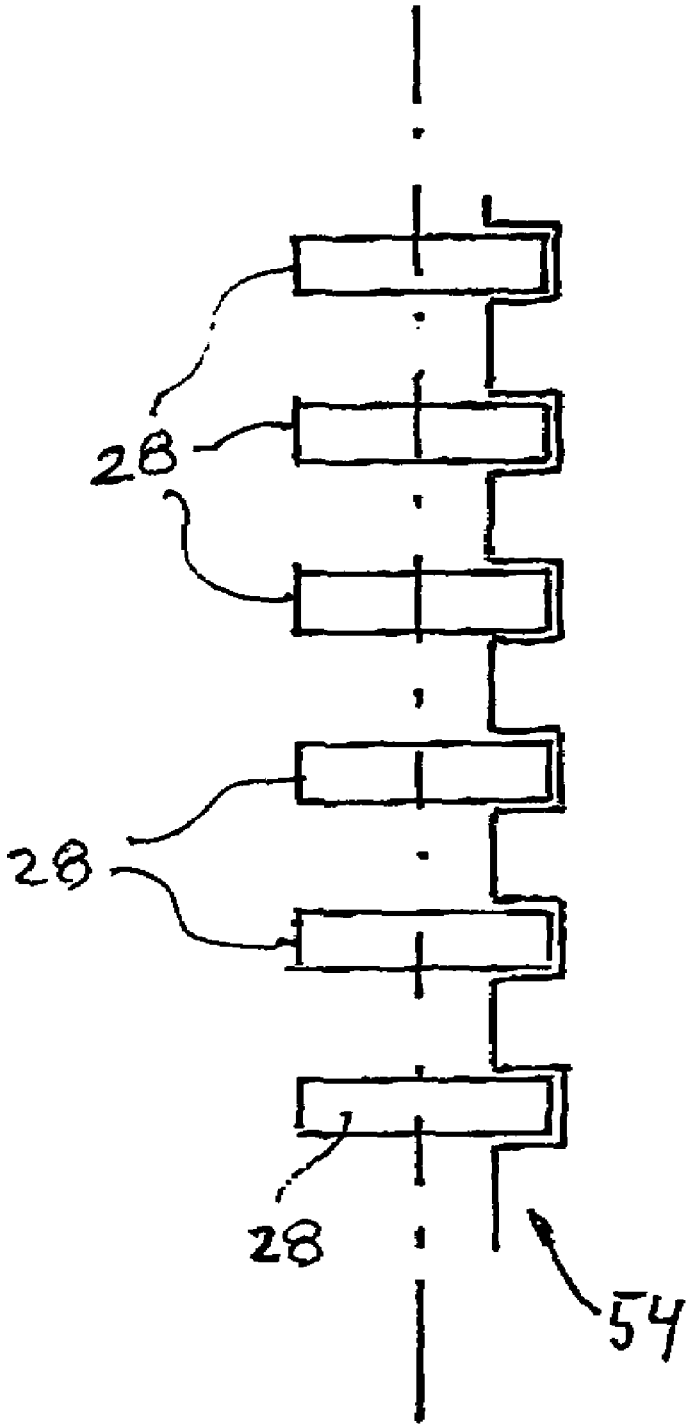
FIG. 5 is a top view of a transport roll comprised of individual axially-spaced rollers positioned between comb teeth of an upper edge flange extending from the container.

For the delivery of individual sheets to the container 12 the rotational drive 30 for the transport rolls 22, 24 and the rotational drive 42 for the segment roll 36 are reversed. The individual sheet is drawn in by the transport rolls 22, 24 and along the guide plate 64 and is pushed into the gap between the segment roll 36 and the stack end surface 56. Before a sheet can be pushed into the container 12 the pressing device 58 is moved slightly backwardly (that is toward the right in FIGS. 2 and 3) by a drive motor 56, whose output pinion 56 meshes with a rack 59, so that the stack end surface 56 lies only loosely against the edge flanges 52 and 54. Then the sheet can without problem be pushed behind the lower edge flange 52. Upon further rotation of the transport rolls oppositely to the direction of the arrows B the sheet again forms a bulge before its trailing edge changes its direction toward the stack end surface 56 and slides behind the upper flange 54. After the delivery of the last individual sheet the pressing force of the pressing device 58 is again increased. If the transport roll 22 is comprised of individually axially spaced rollers the delivery of sheets into the container 12 can further be eased if the upper edge flange 54 is formed as a comb and extends with its comb teeth between the rollers, as is shown in FIG. 5. Thus, the comb structure is essentially the edge flange 54 having recesses that at least partially accommodate the rollers 28. Also, the outer surface of the rollers of the transport roll 22 can be provided with small radial teeth, which improves their sheet gripping effect.

It will be understood that the withdrawal and individualizing device is extremely simple in its construction and by a simple reversal of rotational direction can be used both for the withdrawal as well as for the delivery of individual sheets, with the individual sheets upon delivery to the container also being orderly deposited in stacked condition.

Figure 4:
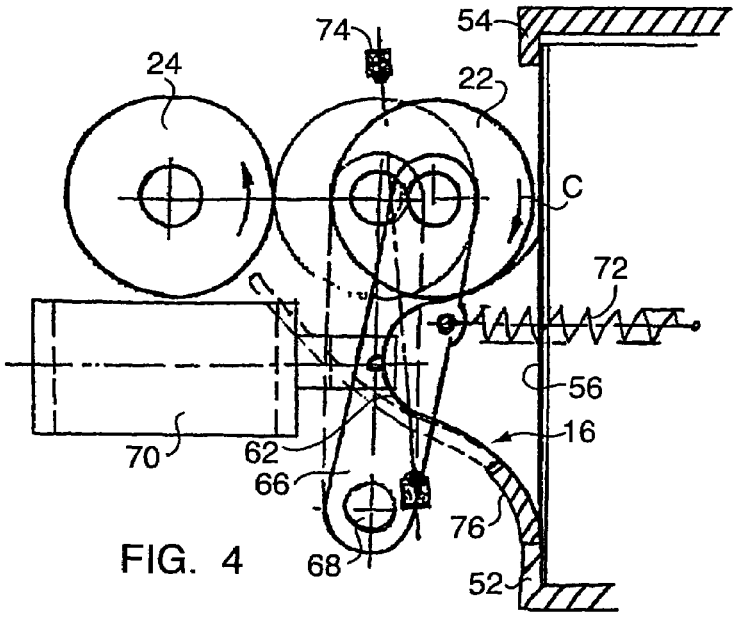

In the exemplary embodiment illustrated schematically in FIG. 4 similar parts are again provided with similar reference characters. This embodiment differs from the embodiment according to FIGS. 1–3 in that no segment roll is provided. Moreover, the transport roll 22 is also used as the shifting element. In this case the transport roll 22 is supported on a pivotal lever 66, which in turn is supported on the frame for movement about an axis 68, and by a positioning magnet 70, adjustably between a position in which the transport roll 22 lies against the end surface 56 of the stack and a position in which it cooperates with the transport roll 24 for transport of the individual sheet 16. If the positioning magnet 70 is unenergized, the pivotal lever 66 is pulled by a spring 72 toward the right in FIG. 4, so that the transport roll 22 lies against the end surface 56 of the stack. If the transport roll 22 in this condition is driven in the clockwise direction (arrow C) the individual sheet forming the end surface 56 of the stack is buckled so that it again forms a bulge 62, which then lies against the circumference of the transport roll 22, as it is illustrated in FIG. 4. When the bulge 62 has reached a given size it extends into the light path of a light cell 74. The response of the light cell 74 is such that the positioning magnet 70 then pivots the pivotal lever 66 in FIG. 4 toward the left, so that the transport roll 22 cooperates with the transport roll 24 for a transport of the individual sheet. The sheet then lying on the circumference of the transport roll 22 is then in the same way as has been explained in connection with FIGS. 2 and 3 guided into the roll gap between the transport rolls 22, 24 and is withdrawingly transported away by those transport rolls.

The delivery of individual sheets occurs in almost the same way as has been explained in connection with FIGS. 2 and 3, with the leading edge of the individual sheet being guided into the container 12 by a curved guide plate 76 which is an extension of the edge flange 52. The rotation of the transport roll 22 in the counterclockwise sense effects the reversal of the end of the individual sheet so that it comes to lies on the end surface 56 of the stack and then upon still further rotational movement of the transport roll, which in the mean time has been moved by the spring 72 in the direction toward the end surface 56 of the stack, it is pushed behind the edge flange 54, with also in this exemplary embodiment the pressing device being so adjusted as has been described above.

What is claimed is:

1. A device for the delivery and/or receipt of individual sheets, comprising:

a parallelepiped container in which individual sheets are stored in the form of a sheet stack, the container having a container wall parallel to one end face of the sheet stack, the container wall having a rectangular pass-through opening with first opposite edges whose spacing from one another is equal to a first edge length of the individual sheets and having second opposite edges whose spacing from one another is smaller than the other edge length of the individual sheets;

means for pressing the individual sheets against the container wall;

a sheet pusher designed to extend into the pass-through opening and to lie onto the end surface of the sheet stack for pushing an individual sheet parallel to the stack end surface and perpendicularly to the second edges;

two transport rolls with axes arranged parallel to the stack end surface and to the second edges and which form a roll gap for gripping an individual sheet, with one of the transport rolls being so arranged near one of the second edges that it, as considered perpendicularly to the stack end surface, lies at least partially inside of the pass-through opening; and drive means for driving the sheet pusher and the transport rolls;

wherein the drive means are reversible in regard to their drive direction.

2. A device according to claim 1, wherein between the transport rolls and the sheet pusher a sheet guide plate is arranged which bridges the spacing between the roll gap and the contact surface of the sheet pusher at the stack end surface.

3. A device according to claim 1, wherein the sheet pusher has at least one engagement element eccentrically supported on an axis parallel to the stack end face.

4. A device according to claim 3, wherein the engagement element is a segment roller.

5. A device according to claim 1, wherein the sheet pusher and the transport rolls together with the drive means are arranged on a frame into which the container is slidably insertable.

6. A device according to claim 1, wherein the transport rolls each have a plurality of coaxial rollers axially spaced from one another, with the rollers of one roll in the axial direction lying between the rollers of the other roll.

7. A device according to claim 1, wherein the axes of the two transport rolls lie in a plane perpendicular to the stack end face and parallel to the second edges.

8. A device for the delivery and/or receipt of individual sheets, comprising:

a parallelepiped container in which individual sheets are stored in the form of a sheet stack, the container having a container wall parallel to one end face of the sheet stack, the container wall having a rectangular pass-through opening with first opposite edges whose spacing from one another is equal to a first edge length of the individual sheets and having second opposite edges whose spacing from one another is smaller than the other edge length of the individual sheets;

means for pressing the individual sheets against the container wall;

a sheet pusher designed to extend into the pass-through opening and to lie onto the end surface of the sheet stack for pushing an individual sheet parallel to the stack end surface and perpendicularly to the second edges;

two transport rolls with axes arranged parallel to the stack end surface and to the second edges and which form a roll gap for gripping an individual sheet, with one of the transport rolls being so arranged near one of the second edges that it, as considered perpendicularly to the stack end surface, lies at least partially inside of the pass-through opening; and drive means for driving the sheet pusher and the transport rolls;

wherein the transport rolls each have a plurality of coaxial rollers axially spaced from one another, with the rollers of one roll in the axial direction lying between the rollers of the other roll; and wherein the second edge near one of the transport rolls is formed as a comb, and with its comb teeth extends into the spaces between the rollers.

9. A device for the delivery and/or receipt of individual sheets, comprising:

a parallelepiped container in which individual sheets are stored in the form of a sheet stack, the container having a container wall parallel to one end face of the sheet stack, the container wall having a rectangular pass-through opening with first opposite edges whose spacing from one another is equal to a first edge length of the individual sheets and having second opposite edges whose spacing from one another is smaller than the other edge length of the individual sheets;

means for pressing the individual sheets against the container wall;

a sheet pusher designed to extend into the pass-through opening and to lie onto the end surface of the sheet stack for pushing an individual sheet parallel to the stack end surface and perpendicularly to the second edges;

two transport rolls with axes arranged parallel to the stack end surface and to the second edges and which form a roll gap for gripping an individual sheet, with one of the transport rolls being so arranged near one of the second edges that it, as considered perpendicularly to the stack end surface, lies at least partially inside of the pass-through opening; and drive means for driving the sheet pusher and the transport rolls;

wherein the pressing device is adjustable by means of a drive.

* * * * *